US005195330A

United States Patent [19]

Kado et al.

[11] Patent Number: 5,195,330

[45] Date of Patent: Mar. 23, 1993

[54] FOOD SERVICE COUNTER OF THE ICE STORAGE TYPE

[75] Inventors: Syuji Kado, Toyoake; Susumu Tatematsu, Nagoya, both of Japan

[73] Assignee: Hoshizaki Denki Kabushiki Kaisha, Toyoake, Japan

[21] Appl. No.: 839,506

[22] Filed: Feb. 21, 1992

[51] Int. Cl.[5] ..... F25C 5/18

[52] U.S. Cl. ..... 62/137; 62/258; 366/208

[58] Field of Search ..... 366/208, 213; 62/137, 62/258, 344

[56] References Cited

U.S. PATENT DOCUMENTS

| | | | |
|---|---|---|---|
| 3,144,755 | 8/1964 | Kattes | 62/137 |
| 3,192,734 | 7/1965 | Swanson | 62/137 |
| 4,227,377 | 10/1980 | Miller | 62/137 X |
| 4,863,847 | 2/1989 | Koeneman et al. | 62/137 X |

*Primary Examiner*—William E. Tapolcai
*Attorney, Agent, or Firm*—Nikaido, Marmelstein, Murray & Oram

[57] ABSTRACT

An ice storage type food service counter includes an ice storage tank (20) arranged to store an amount of ice and having a drain hole (24) at a bottom, an ice supply device (30) for automatically producing chips of ice and supplying the same into the ice storage tank (20), an agitating device (40) arranged within the ice storage tank for agitating and leveling the chips of ice stored in the ice storage tank, a container (B) formed to contain food and drink therein and mounted on the agitating device (40) to be displayed on the stored chips of ice, a water supply tank (50) arranged to store an amount of ice making water for use in the ice supply device (30), and a discharge tank (60) arranged below the ice storage tank (20) to store the water of melted ice discharged from the ice storage tank through a drain pipe (61) in connection to the drain hole.

6 Claims, 7 Drawing Sheets

FOOD SERVICE COUNTER OF THE ICE STORAGE TYPE

BACKGROUND OF THE INVENTION

1. Field of the Invention

The present invention relates to a food service counter of the ice storage type for displaying containers, which can contain cold berverages and food, such as salad, on ice.

2. Description of the Prior Art

There has been provided an ice storage type food service counter which is designed to display containers containing drink and food within an ice storage tank where chips of ice prepared by an ice making machine are manually carried and leveled.

Such a conventional ice storage type food service counter, however, requires that chips of ice be manually carried into the ice storage tank and leveled, and that, every time ice melts away, ice be supplemented and leveled also manually. This is inconvenient for users.

SUMMARY OF THE INVENTION

The present invention has been achieved with a view to solving the above problems, and it is therefore a primary object of the present invention to provide an ice storage type food service counter wherein fresh chips of ice are automatically supplied into an ice storage tank and leveled, which service counter can be used at a place such as an assembly hall of a hotel where water supply and drain facilities are unavailable.

A secondary object of the present invention is to provide an ice storage type food service counter which is designed to prevent water leakage therefrom in the case that it has been installed at a place where water supply and drain facilities are unavailable.

A tertiary object of the present invention is to provide an ice storage type food service counter which can be used for a long time at a place where water supply and drain facilities are unavailable.

A fourth object of the present invention is to provide an ice storage type food service counter which can be used for a long time without causing any water leakage when it has been installed at a place where water supply and drain facilities are unavailable.

A fifth object of the present invention is to provide an ice storage type food service counter which can be preliminarily prepared for use at a place such as a cooking room where water supply and drain facilities are available and can be used for a long time without any waiting time at a place where water supply and drain facilities are unavailable.

A sixth object of the present invention is to provide an ice storage type food service counter capable of draining the used water therefrom in a short time.

According to the present invention, there is porivided an ice storage type food service counter which comprises an ice storage tank arranged to store an amount of ice and having a drain hole at a bottom, an ice supply device for automatically producing chips of ice and supplying the same into the ice storage tank, an agitating device arranged within the ice storage tank for agitating and leveling the chips of ice stored in the ice storage tank, a container formed to contain food and drink therein and mounted on the agitating device to be displayed on the stored chips of ice, a water supply tank arranged to store an amount of ice making water for use in the ice supply device, and a discharge tank arranged below the ice storage tank to store the water of melted ice discharged from the ice storage tank through the drain hole. The ice storage type food service counter further comprises a discharge pipe connected at one end thereof to the drain hole and provided at an intermediate portion thereof with an electromagnetic drain valve through which the water of melted ice is discharged into the discharge tank, a water level detector arranged to detect the level of water in the discharge tank, and a control device for closing the drain valve and deactivating the ice supply device when the level of water detected by the level detector becomes a maximum allowable level.

According to one aspect of the present invention, there is provided an ice storage type food service counter wherein the water supply tank and the discharge tank are communicated to each other at their bottoms or intermediate portions by means of a communication pipe which is provided with an electromagnetic valve of the normally closed type to be opened under control of the control device when the level of water detected by the water level detector approaches the maximum allowable level, which food service counter further comprises a second water level detector arranged within the water supply tank to detect the level of ice making water stored therein, whereby when the level of ice making water detected by the second water level detector becomes the maximum allowable level, the electromagnetic drain valve is closed and the ice supply device is deactivated under control of the control device.

According to another aspect of the present invention, there is provided an ice storage type food service counter wherein the water supply tank is provided with a second water level detector for detecting the level of ice making water stored therein and is connected to a water supply pipe for connection to a water service pipe, and wherein the water supply pipe is provided with an electromagnetic water supply valve to be closed under control of the control device when the level of ice making water detected by the second water level detector becomes the maximum allowable level.

According to a further aspect of the present invention, there is provided an ice storage type food service counter which comprises an ice storage tank arranged to store an amount of ice and having a drain hole at a bottom, an ice supply device for automatically producing chips of ice and supplying the same into the ice storage tank, an agitating device arranged within the ice storage tank for agitating and leveling the chips of ice stored in the ice storage tank, a container formed to contain food and drink therein and mounted on the agitating device to be displayed on the stored chips of ice, a water supply tank arranged to store an amount of ice making water for use in the ice supply device, and a discharge tank arranged below the ice storage tank to store the water of melted ice discharged from the ice storage tank through a discharge pipe in connection to the drain hole, an electromagnetic valve disposed within a communication pipe between the bottoms of the water supply tank and the discharge tank, and a discharge pump arranged to discharge the water from the water supply tank or the discharge tank.

DESCRIPTION OF THE PREFERRED EMBODIMENTS

Figure 1:
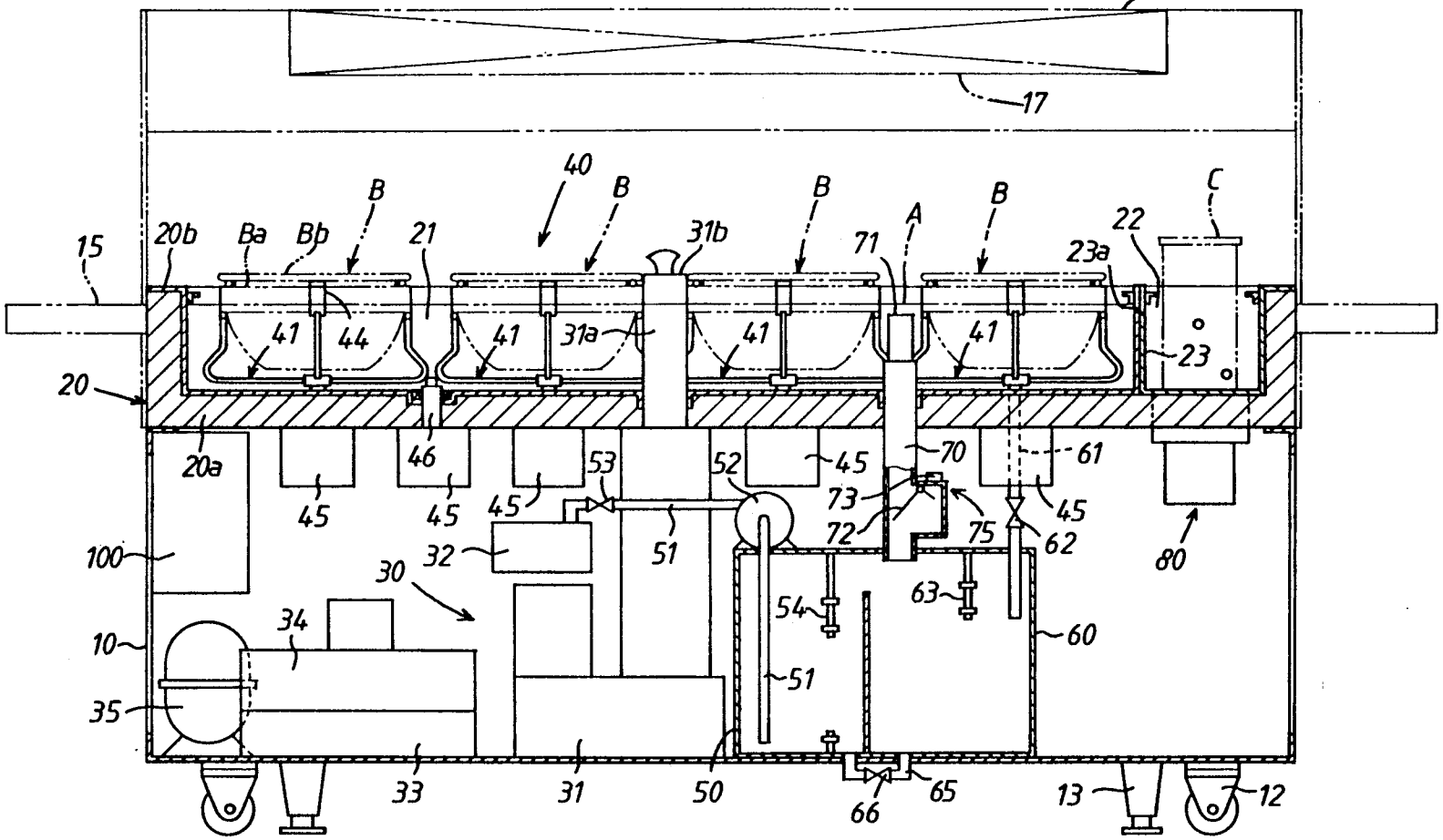
FIG. 1 is a vertical sectional view of a first embodiment of an ice storage type food service counter according to the present invention.

Referring now to the drawings, a first embodiment of the present invention will be described with reference to FIGS. 1 and 2. As shown in FIG. 1, an ice storage tank 20 is mounted on a support frame 10 which is supported on the floor by means of casters 12 and vertically adjustable legs 13. Provided in the support frame 10 are an ice supply device 30 for automatically supplying chips of ice into the ice storage tank 20, a water supply tank 50, a discharge tank 60, a control device 100, etc., as well as the essential portions of an agitating device 40 which is arranged to agitate chips of ice supplied into the ice storage tank 20 to level them. A table 15 is provided around the ice storage tank 20. Above the ice storage tank 20 is located an open type hood 16 provided with a lighting equipment 17.

Figure 2:
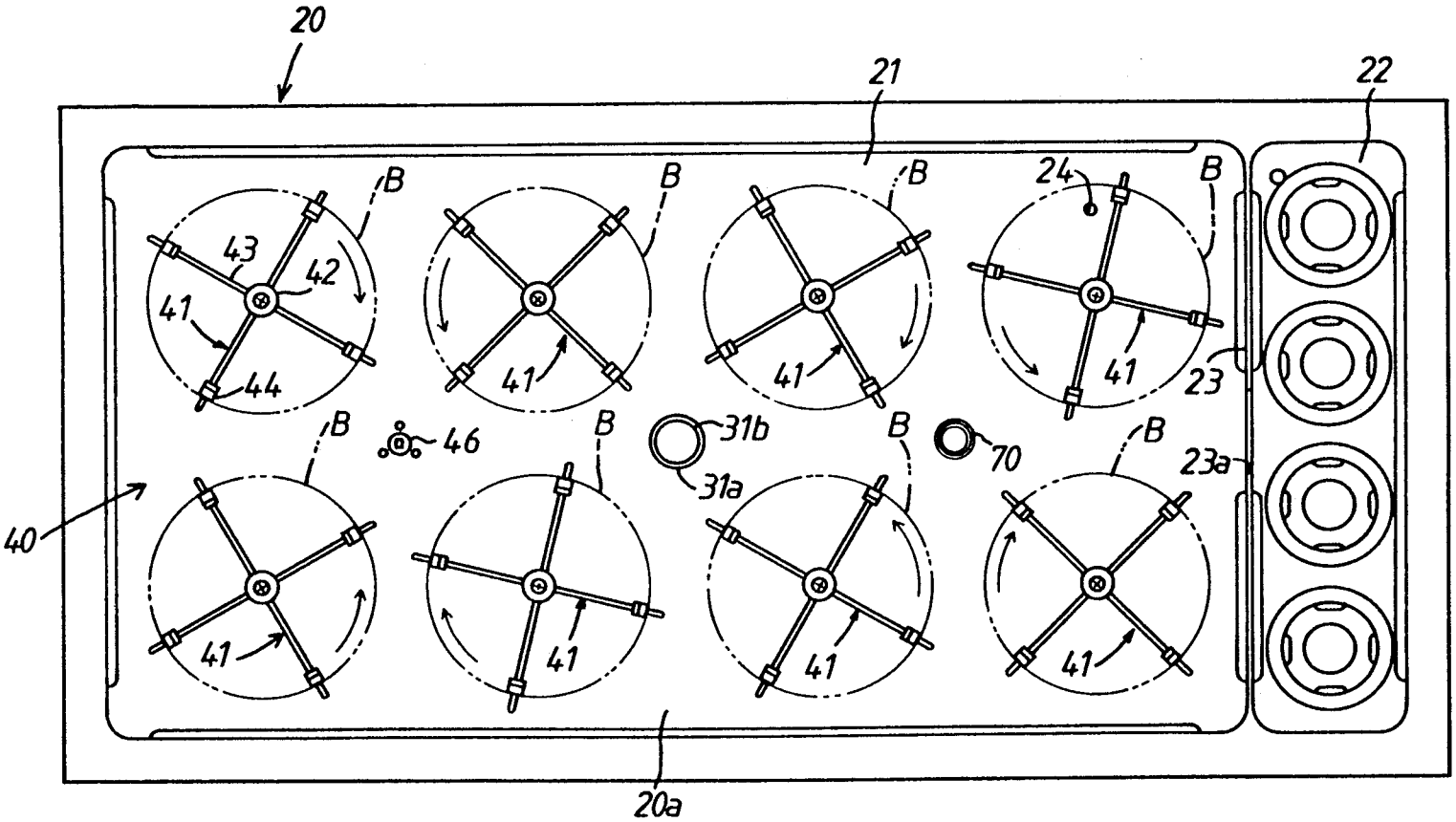
FIG. 2 is a plan view of the food service counter shown in FIG. 1.

As shown in FIGS. 1 and 2, the ice storage tank 20 comprises an insulative outer box lined with a rust preventing material, such as stainless steel or resin, shaped into a rectangular shallow box with top open. Part of the line of the ice storage tank 20 stands upright to form a partition 23 which separates the interior of ice storage tank 20 into a large main tank 21 and a small sub-tank 22. A recess 23*a* is formed in the center of the upper edge of partition 23 to permit communication between both tanks 21 and 22. The lower edge of the recess 23*a* is positioned slightly lower than a predetermined ice level A as will be described later. As shown in FIG. 2, a drain hole 24 is formed in the bottom of main tank 21.

The ice supply device 30 in this embodiment is in the form of a well-know auger type ice making machine whose essential portions include an ice making mechanism 31, a water tank 32, a condenser 33, a cooling fan 34 and a compressor 35, which are all disposed within the support frame 10, except for the top portion of the ice making mechanism 31. The ice making mechanism 31 comprises an evaporator, an auger and a drive motor (not shown). A vertical cylindrical member 31*a* extends into the main tank 21 through a bottom plate 20*a* of the ice storage tank 21 in a liquid-tight manner. The vertical cylindrical member 31*a* has an ice delivery port 31*b* provided at the top, slightly higher than an upper edge 20*b* of the ice storage tank 20. As will be described later, ice making water supplied to the water tank 32 from the water supply tank 50 is supplied to the ice making mechanism 31 where it is formed into chips of ice of about 1 to 20 $cm^3$ in size, and the chips of ice are carried up to fall into the main tank 21 from the delivery port 31*b*.

As shown in FIGS. 1 and 2, the agitating device 40 comprises agitators 41 respectively mounted on a plurality of drive shafts 46, and drive motors 45 for rotating the drive shafts 46. In this embodiment, there are nine geared motors used as the drive motors 45, with their output shafts being the drive shafts 46. Each drive motor 45 is fixedly mounted to the bottom of ice storage tank 20, with the drive shaft 46 extending into the ice storage tank 20 through the bottom plate 20*a* in a liquid-tight manner. As shown in FIG. 2 of a plan view, the individual drive shafts 46 are arranged eight in two rows at equal lateral and longitudinal distances and the last one located just at the center of those four drive shafts which are located away from the sub-tank 22 than the other four. Each drive shaft 46 has rectangular free end where the associated agitator 41 is mounted. Although in this embodiment, each drive shaft 46 is driven by a single drive motor 45 and its rotational speed and direction can be finely adjusted by the control device 100, the individual drive shafts 46 may be linked by a link mechanism to be driven by fewer drive motors.

As shown in FIGS. 1 and 2, the agitator 41 has a boss section 42 to be detachably mounted to the free end of the drive shaft 46, four arm portions 43 each having one end fixed to the boss section 42 and extending radially outwardly before bent upward, and stoppers 44 pivoted the upper ends of the respective arm portions 43. Each boss section 42 has a rectangular hole in the center in which the top end of the drive shaft 46 is to be fitted, and is securely fastened to the drive shaft 46 by means of a screw. The rotational speed of the agitator 41 is several rotations per minute. Although in this embodiment the rotational directions of the individual agitators 41 are determined in the opposite directions as illustrated in FIG. 2, the agitators may be arranged to rotate in various other direction patterns.

Containers B each comprise a transparent glass support container Ba and a service container Bb. The support container Ba is attached to the associated agitator 41 with its edge portion held by the stoppers 44, and is designed to receive the service container Bb which contains cold food and drink, such as salad. Although the agitator 41 is not mounted on the drive shaft 46 at the left center in FIG. 2 in this embodiment, the drive shaft 46 is reserved for the use to mount, for example, a large agitator 41 for supporting a container of large diameter (not shown), in which case small agitators (not shown) are mounted to the surrounding four drive shafts 46, or no agitators are mounted thereon. Alternatively, the small agitators for supporting containers of small diameter may be mounted on those five drive shafts 46.

Although the water supply tank 50 and the discharge tank 60 are provided by separating a single tank with a partition as shown in FIG. 1, they may be provided as independent and separate tanks. The tanks 50 and 60 are provided with a water supply level detector 54 and a water discharge level detector 63, respectively, and the bottoms of both tanks 50 and 60 are communicated to each other through a communication pipe 65 provided with an electromagnetic valve 66. The tanks 50 and 60 are each provided with a drain cock (not shown). Water in the water supply tank 50 is supplied to the water tank 32 through a water supply pipe 51 provided with a water supply pump 52 and an electromagnetic water supply valve 53. The level of water in the water tank 32 is kept almost constant by controlling the water pump 52 and the electromagnetic water supply valve 53 by means of a float switch (not shown) which is activated when the level of water in tank 32 becomes a predetermined level. Alternatively, the float switch may be replaced with an overflow pipe provided within the water tank 32 recirculate the ice making water into the water supply tank 50 therethrough. In such a case, the water pump 52 is continuously operated during activation of the ice making mechanism 31 so that an excessive amount of the ice making water is circulated into the water supply tank 50 through the overflow pipe to maintain the level of ice making water in tank 32 at the predetermined level. The drain hole 24 in the bottom of main tank 21 communicates with the interior of the discharge tank 60 through a discharge pipe 61 provided with an electromagnetic discharge valve 62 through which the water of melted ice in main tank 21 is discharged into the discharge tank 60.

As shown in FIGS. 1 and 2, an overflow pipe 70 is provided vertically in the ice storage tank 20, extending upward through the bottom plate 20*a* of tank 20. The overflow pipe 70 has an upper opening 71 located slightly lower than the upper edge 20*b* of tank 20 and a lower end opening into the interior of the discharge tank 60. When the level of chips of ice, supplied from the ice supply device 30 into the main tank 21 and leveled by the agitating device 40, reaches the predetermined ice level A slightly higher than the upper opening 71 of overflow pipe 70 (but lower than the upper edge 20*b* of tank 20), individual chips of ice fall into the discharge tank 60 through the overflow pipe 70. Provided at an intermediate portion of overflow pipe 70 is an ice detection device 75 which comprises a spring loaded flapper 72 slightly pressed into contact with an inner wall of overflow pipe 70 and a proximity switch 73 cooperable with the flapper 72. The control device 100 has various kinds of operation switches and is responsive of electric signals from the detection devices 54, 63 and 75 to control each operation of the ice supply device 30, agitating device 40 and electromagnetic valves 53, 62, 66. In addition, the sub-tank 22 is formed to contain four salad-dressing containers C the interior of which is agitated by an agitating device 80. The agitating device 80 is of a noncontact permanent magnetic type, which is constructed to rotate an impeller (not shown) mounted with the bottom portion of salad-dressing container C.

In operation of the food service counter, water in the water supply tank 50 is fed by operation of the water pump 52 to the water tank 32 from which it is supplied to the ice making mechanism 31 to be formed into chips of ice. The chips of ice are then supplied into the main tank 21 from the ice delivery port 31*b*. Simultaneously, the supplied chips of ice are automatically distributed all over the interior of main tank 21 and leveled by rotation of the agitators 41. When the level of ice in main tank 21 reaches the predetermined ice level A, those pieces of ice above the level A fall into the discharge tank 60 through the overflow pipe 70. When the ice passing through the overflow pipe 70 is detected by the ice detection device 75, the control device 100 acts in response to a detection signal from the detection device 75 to temporarily deactivate teh ice making mechanism 31 for a predetermined time thereby to maintain the level of ice in main tank 21 at the predetermined ice level. In such a situation, the food service counter is used with the service containers Bb containing food and drink and placed in the support containers Bb. When the ice making water in tank 50 is consumed, the ice making mechanism 31 is deactivated under control of the control device 100.

During use of the food service counter, fresh chips of ice fall into the main tank 21 from the ice delivery port 31*b* piece by piece, and the pieces of ice in main tank 21 are moved around by operation of the agitators 41. Thus, an excellent display effect can be obtained as well as the food and drink in the service containers Bb can be refrigerated. The water of melted ice in main tank 21 is discharged from the drain hole 24 into the discharge tank 60 through the discharge pipe 61 and electromagnetic discharge valve 62. When the level of water in the discharge tank 60, which is detected by the water discharge level detector 63, becomes the maximum allowable level, the control device 100 acts to close the electromagnetic discharge valve 62 and to deactivate the ice supply device 30 if it is being activated. In this instance, the deactivation of ice supply device 30 may be delayed after closure of the electromagnetic valve 62. Thus, leakage of the water from the discharge tank 60 is avoided. Even when the electromagnetic discharge valve 62 has been closed, the food service counter can be used in a condition where the agitating device 40 is being operated.

The electromagnetic communication valve 66 is normally closed to be opened under control of the control device 100 when the ice making water in tank 50 is eliminated or the level of water in discharge tank 60 becomes the maximum allowable level. Assuming that the electromagnetic communication valve 66 has been opened, the water supply tank 50 becomes a portion of the discharge tank 60 to increase the capacity of discharge tank 60. This is useful to prolong the usable time of the food service counter. The water flowing into the water supply tank 50 from the discharge tank 60 can be recycled as the ice making water. If an amount of ice is preliminarily supplied into the ice storage tank 20 prior to use of the food service counter or the ice supply device 30 is activated in a condition where the water supply tank 50 is connected to a water service pipe, the level of water in tank 50 will become the maximum allowable level. In such a situation, the electromagnetic discharge valve 62 is closed under control of the control device 100, and the ice supply device 30 is also deactivated if it is activated.

Figure 3:
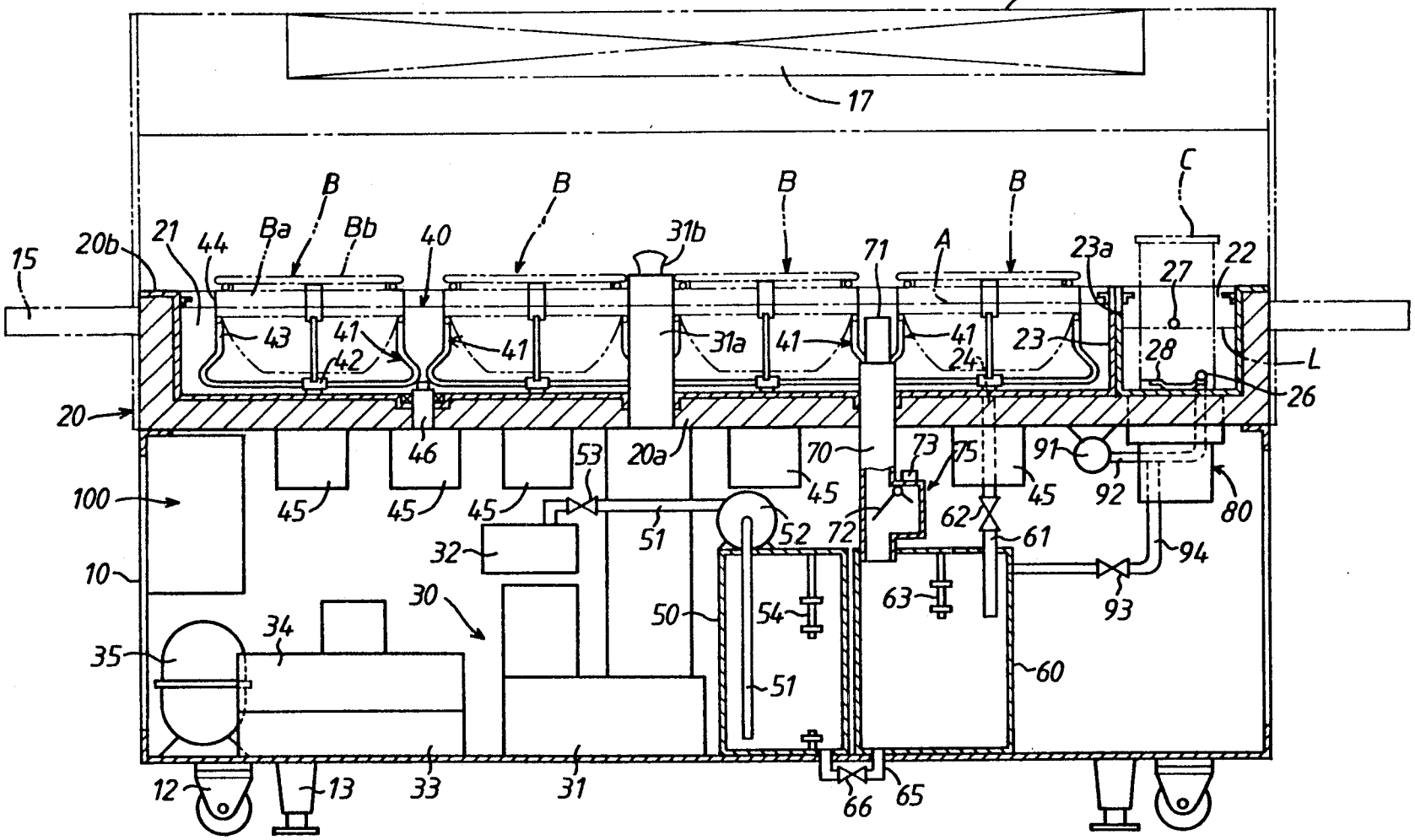
FIG. 3 is a vertical sectional view of a second embodiment of an ice storage type food service counter according to the present invention.
Figure 4:
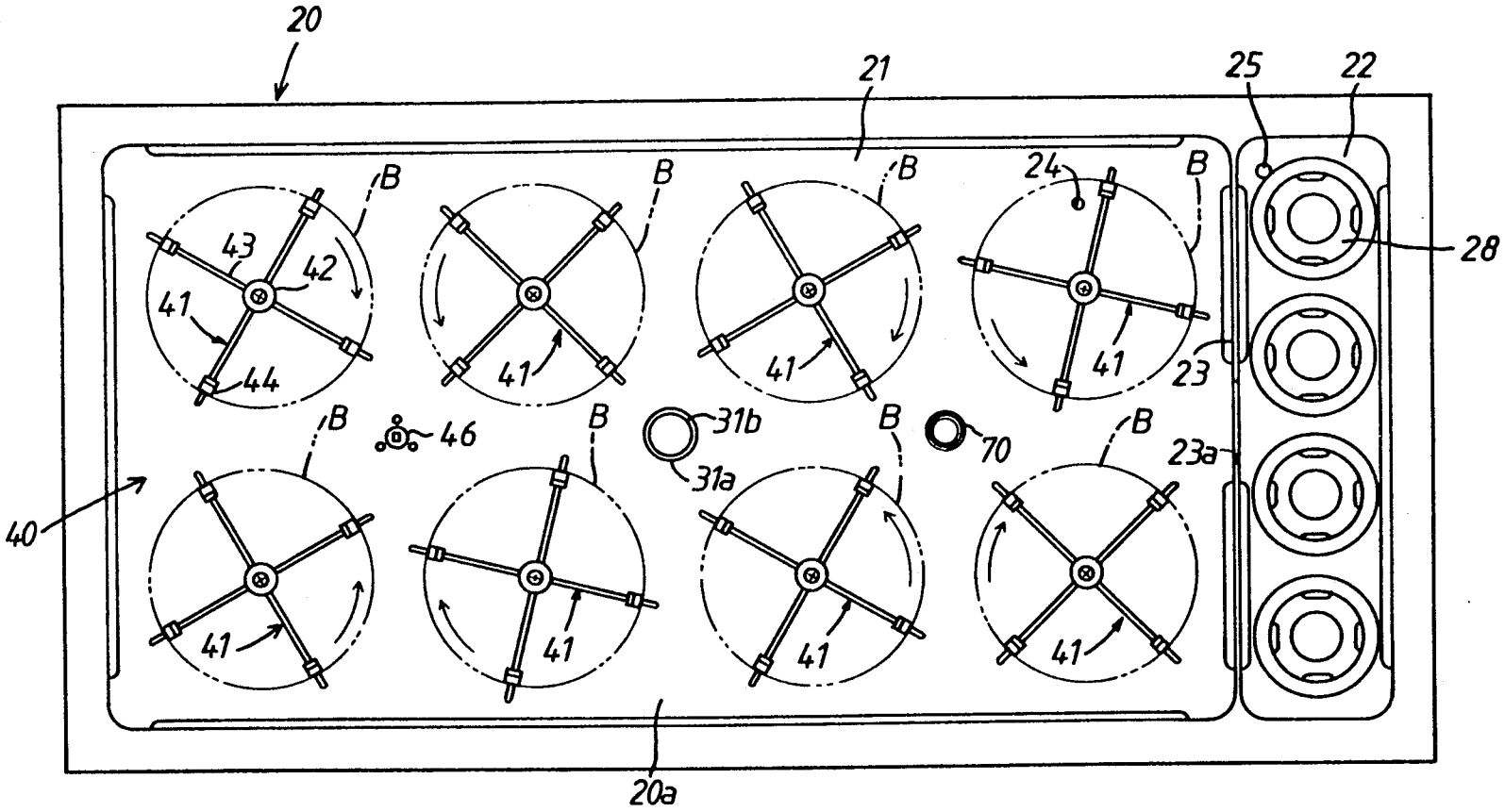
FIG. 4 is a plan view of the food service counter shown in FIG. 3.

In FIGS. 3 and 4, there is illustrated a second embodiment of the food service counter, wherein the water supply tank 50 is separated from the discharge tank 60. In this embodiment, the sub-tank 22 is formed at its bottom with a drain hole 25 (see FIG. 4) and at its side wall with an inlet hole 26. The drain hole 25 is connected to the inlet hole 26 by means of a communication pipe 92 provided with a circulation pump 91. The communication pipe 92 is connected at its intermediate portion to the discharge tank 60 by means of a bypass pipe 94 provided with a drain cock 93. The sub-tank 22 is further formed with an overflow hole 27 which is located slightly lower than the recess 23*a* to discharge the water more than a predetermined level L. The overflow hole 27 is connected to the discharge tank 60 by means of a discharge pipe (not shown). A mounting bracket 28 is fixedly mounted on the bottom of sub-tank 22 to be detachably engaged with the bottom of dressing container C. The other construction is substantially the same as that of the first embodiment.

Figure 5:
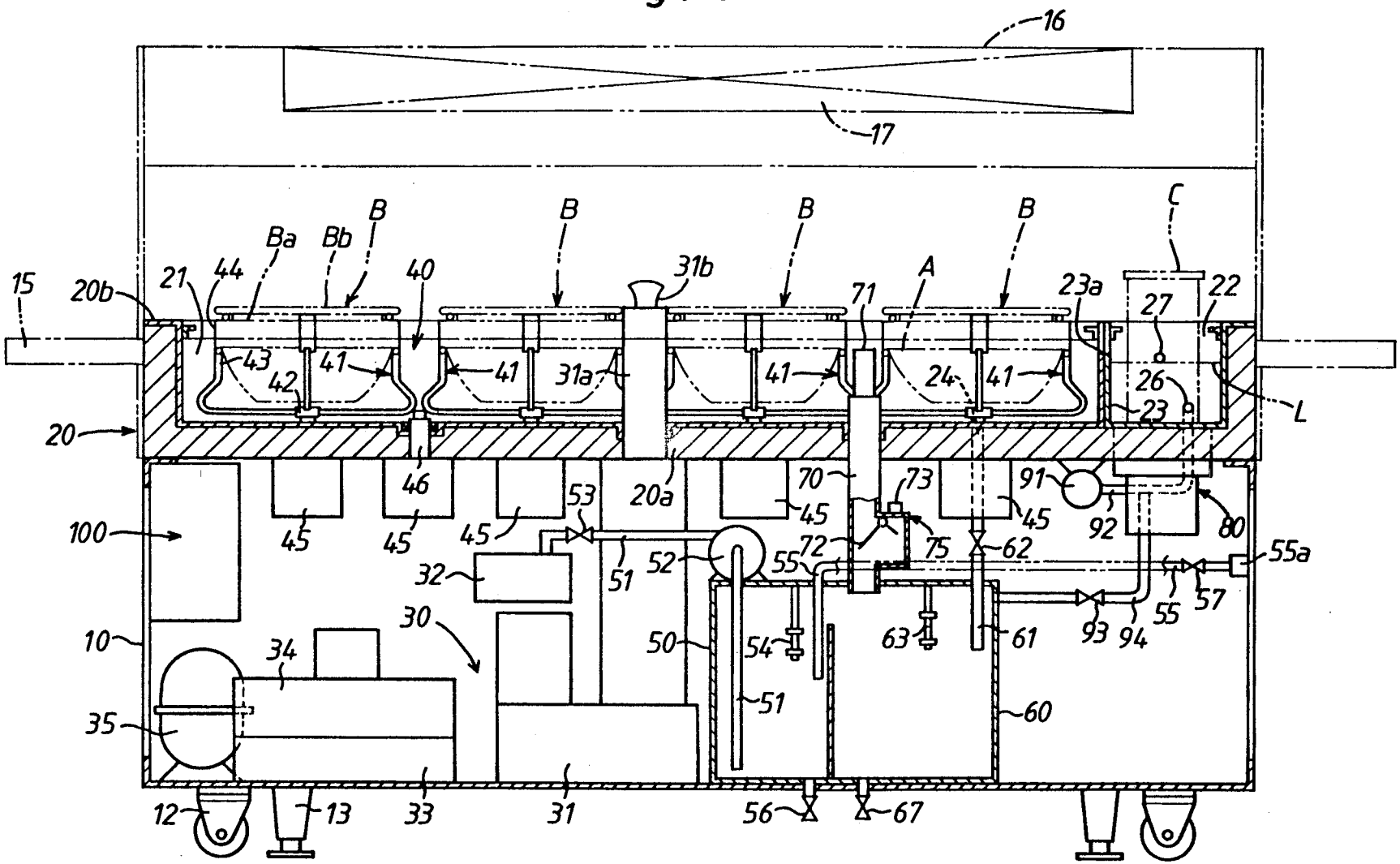
FIG. 5 is a vertical sectional view of a third embodiment of an ice storage type food service counter according to the present invention.

FIG. 5 illustrates a third embodiment of the food service counter, wherein a water supply pipe 55 with a fitting 55*a* for connection to a water service pipe is extended into the water supply tank 50. The water supply pipe 55 is provided with an electromagnetic water supply valve 57 of the normally closed type which is closed under control of the control device 100 when the level of water in tank 50 becomes the maximum allowable level. The water supply tank 50 is provided at its bottom with a drain cock 56, while the discharge tank 60 is provided at its bottom with a drain cock 67. The other construction is substantially the same as that of the first embodiment.

When the food service counter of the third embodiment is used at a place such a cooking room where water supply and drain facilities are available, the water supply pipe 55 is connected to the water service pipe by means of an appropriate hose to supply fresh water into the water supply tank 50. When the level of water in tank 50 becomes the predetermined level, the ice supply device 30 is activated to be supplied with the fresh water for automatically producing chips of ice. In the case that the food service counter is used at a place such as an assembly hall of a hotel where water supply and drain facilities are unavailable, the water supply tank 50 is preliminarily filled with fresh water so that chips of ice are automatically produced by the ice supply device 30. In the case that the ice supply device 30 is activated to preliminarily supply a sufficient amount of ice into the ice storage tank 20 at the place where the water supply and drain facilities are available, the food service counter can be used without any waiting time when transferred to the place where the water supply and drain facilities are unavailable. Since the water supply tank 50 can be preliminarily filled with fresh water, the food service counter can be used for a long time at the place where the water supply and drain facilities are unavailable. When the food service counter is used at the place where the water supply and drain facilities are available, the drain cock 67 is opened to eliminate the water remained in the discharge tank 60.

Although in the third embodiment, only the water supply tank 50 is supplied with fresh water from the water service pipe through the water supply pipe 55, it is able to further supply fresh water into the water tank 32 from the water service pipe through the water supply pipe 55. In such a case, the electromagnetic water supply valve 57 is arranged adjacent the water supply tank 50, and an additional water supply pipe bifurcated from an upstream of the electromagnetic water supply valve 57 is extended into the water tank 32 and provided with an electromagnetic valve through which fresh water is supplied into the water tank 32. The electromagnetic valve of the additional water supply pipe is operated under control of the control device 100 in response to operation of the float switch in tank 32 so that the level of water in tank 32 is maintained at the predetermined level.

Figure 6:
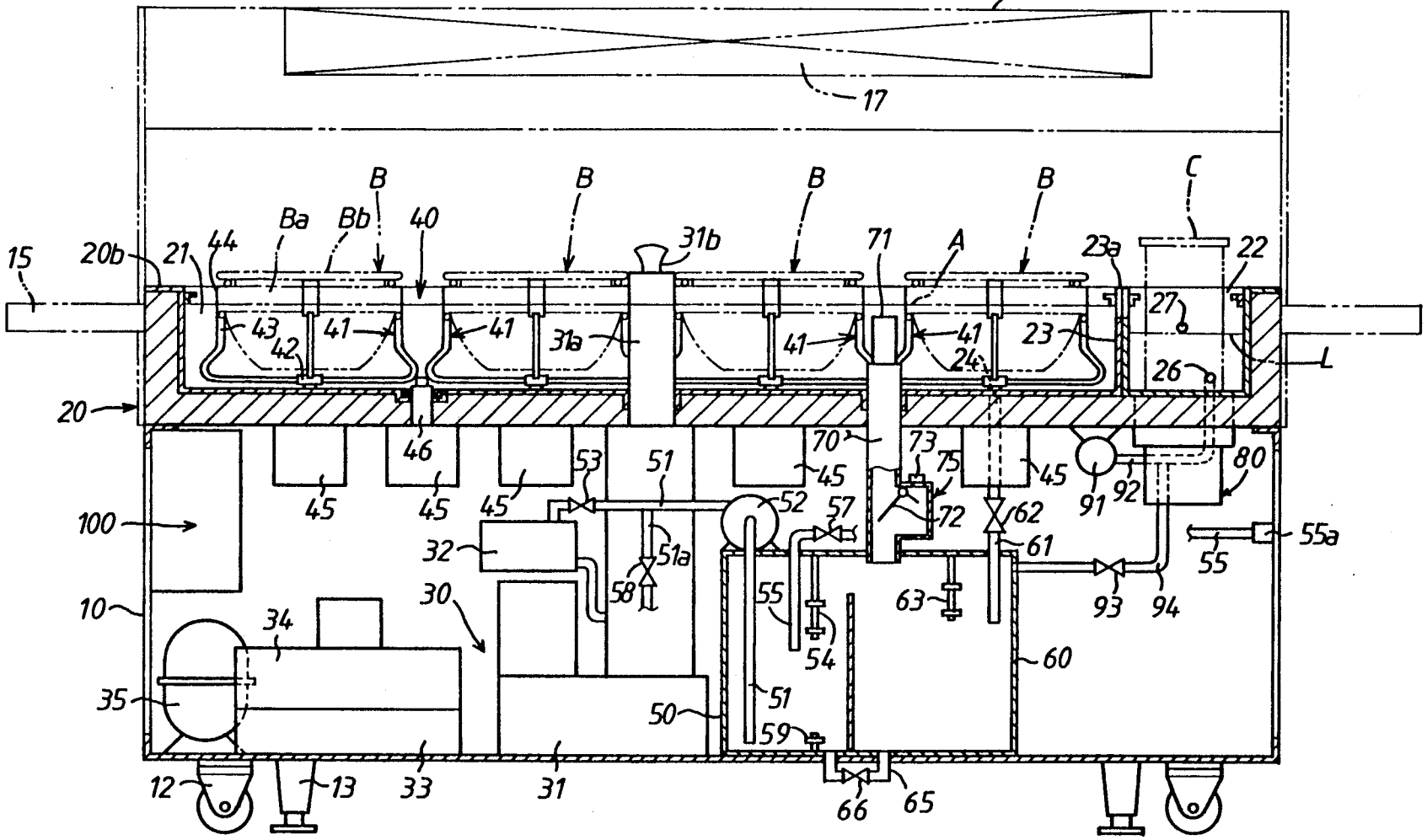
FIG. 6 is a vertical sectional view of a fourth embodiment of an ice storage type food service counter according to the present invention.
Figure 7:
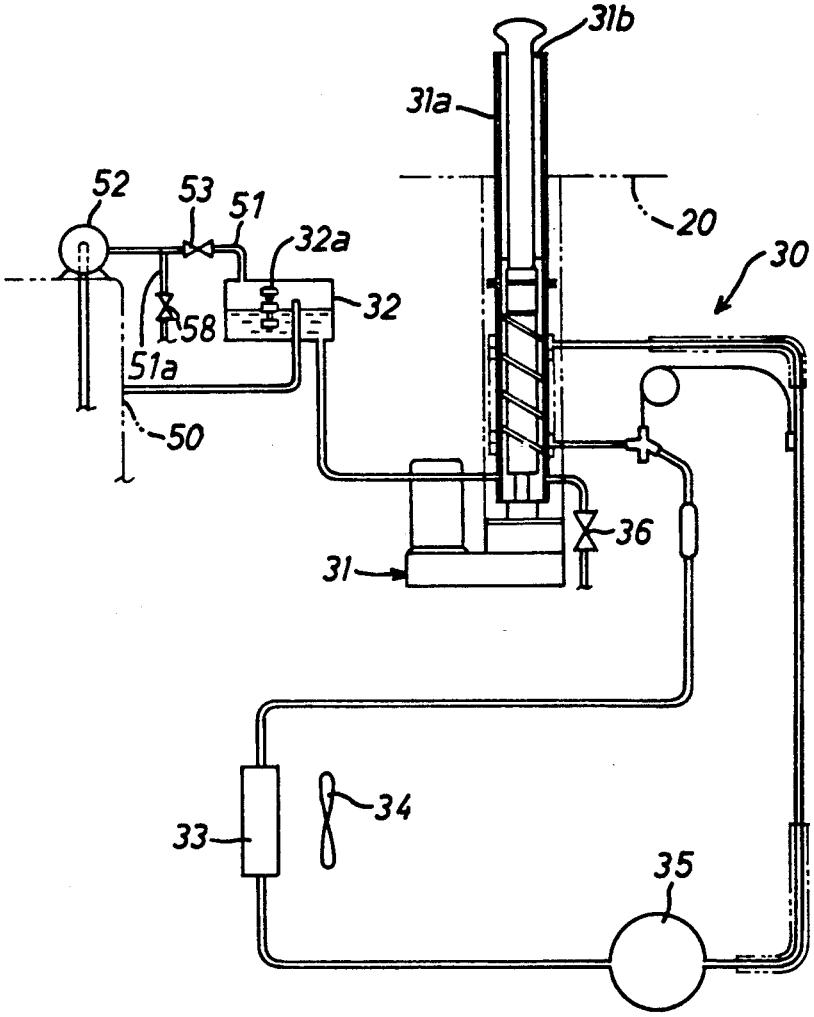
FIG. 7 is a schematic illustration of an ice supply device shown in FIG. 6.

In FIGS. 6 and 7, there is illustrated a fourth embodiment of the food service counter, wherein the ice making water in tank 50 is supplied to the water tank 32 by means of the water supply pipe 51 provided with the water pump 52 and electromagnetic valve 53, and wherein the water pump 52 and electromagnetic valve 53 are operated under control of the control device 100 in response to operation of the float switch 32*a* in tank 32 (see FIG. 7) so that the level of water in tank 32 is maintained at the predetermined level. In this embodiment, a drain pipe 51*a* is bifrucated from the water supply pipe 51 at a position between the water pump 52 and electromagnetic valve 53 and is provided with an electromagnetic drain valve 58 of the normally closed type which is opened under control of the control device 100 in response to operation of a drain switch (not shown). As shown in FIG. 7, a drain pipe is connected to the ice making mechanism 31 and is provided with an electromagnetic drain valve 36 of the normally closed type which is opened under control of the control device 100 in response to operation of the drain switch. When the electromagnetic drain valves 58 and 36 are opened, the electromagnetic communication valve 66 located at the bottom of water supply tank 50 is opened under control of the control device 100, while the electromagnetic valve 53 of water supply pipe 51 is closed under control of the control device 100. In this instance, the water pump 52 is activated under control of the control device 100 to discharge the water from tanks 50, 60 through the drain pipe 51*a*. The draining operation is automatically stopped under control of the control device 100 when the drain of water is detected by a float switch 59 arranged within the bottom portion of tank 50. In a practical embodiment, the suction side opening of water supply pipe 51 is positioned to fully discharge the remaining water from tank 50.

Although in the fourth embodiment the water pump 52 has been utilized as a discharge pump, either one of tanks 50, 60 may be provided with a discharge pump separately from the water pump 52. In such a case, it is not needed to provide the drain pipe 51*a* and electromagnetic drain valve 58.

What is claimed is:

1. An ice storage type food service counter comprising an ice storage tank arranged to store an amount of ice and having a drain hole at a bottom, an ice supply device for automatically producing chips of ice and supplying the same into the ice storage tank, an agitating device arranged within the ice storage tank for agitating and leveling the chips of ice stored in the ice storage tank, a container formed to contain food and drink therein and mounted on the agitating device to be displayed on the stored chips of ice, a water supply tank arranged to store an amount of ice making water for use in the ice supply device, and a discharge tank arranged below the ice storage tank to store the water of melted ice discharged from the ice storage tank through said drain hole.

2. An ice storage type food service counter as claimed in claim 1, further comprising a discharge pipe connected at one end thereof to said drain hole and provided at an intermediate portion thereof with an electromagnetic drain valve through which the water of melted ice in said ice storage tank is discharged into said discharge tank, a water level detector arranged to detect the level of water in said discharge tank, and a control device for closing said electromagnetic drain valve and deactivating said ice supply device when the level of water detected by said level detector becomes a maximum allowable level.

3. An ice storage type food service counter as claimed in claim 2, wherein said water supply tank and said discharge tank are communicated to each other at their bottoms or intermediate portions by means of a communication pipe which is provided with an electromagnetic communication valve of the normally closed type to be opened under control of said control device when the level of water detected by said water level detector approaches the maximum allowable level.

4. An ice storage type food service counter as claimed in claim 3, further comprising a second water level detector arranged within said water supply tank to detect the level of ice making water stored therein, whereby when the level of ice making water detected by said second water level detector becomes the maximum allowable level, said electromagnetic drain valve is closed and said ice supply device is deactivated under control of said control device.

5. An ice storage type food service counter as claimed in claim 1, wherein said water supply tank is provided with a second water level detector for detecting the level of ice making water stored therein and is connected to a water supply pipe for connection to a water service pipe, and wherein said water supply pipe is provided with an electromagnetic water supply valve to be closed under control of said control device when the level of ice making water detected by said second water level detector becomes the maximum allowable level.

6. An ice storage type food service counter comprising an ice storage tank arranged to store an amount of ice and having a drain hole at a bottom, an ice supply device for automatically producing chips of ice and supplying the same into the ice storage tank, an agitating device arranged within said ice storage tank for agitating and leveling the chips of ice stored in said ice storage tank, a container formed to contain food and drink therein and mounted on said agitating device to be displayed on the stored chips of ice, a water supply tank arranged to store an amount of ice making water for use in said ice supply device, and a discharge tank arranged below said ice storage tank to store the water of melted ice discharged from said ice storage tank through a drain pipe in connection to the drain hole, an electromagnetic communication valve disposed within a communication pipe between the bottoms of said water supply tank and said discharge tank, and a discharge pump arranged to discharge the water from said water supply tank or said discharge tank.

* * * * *